United States Patent [19]

Heyden

[11] 3,935,378

[45] Jan. 27, 1976

[54] STAND-OFF INSULATORS

[75] Inventor: Herbert Frank Heyden, Pelham, N.Y.

[73] Assignee: Union Plastics Corporation, Springfield, N.J.

[22] Filed: May 17, 1974

[21] Appl. No.: 470,750

[52] U.S. Cl. ..... 174/158 R; 174/168; 248/42; 248/43; 248/74 B; D26/10

[51] Int. Cl.[2] ..... H01B 17/14

[58] Field of Search ..... 174/158 R, 158 F, 163 R, 174/164, 166 R, 166 S, 168, 174, 194, 202, 205, 212; D8/230; D26/10; 248/40, 42, 43, 65, 74 R, 74 B, 200, 221, 314

[56] References Cited

UNITED STATES PATENTS

| | | | |
|---|---|---|---|
| 466,960 | 1/1892 | Bert et al. | 248/42 |
| 1,192,690 | 7/1916 | Schaake | 174/194 X |
| 1,755,971 | 4/1930 | Smalley | 174/158 R |
| 2,198,839 | 4/1940 | Pittman et al. | 248/65 |
| D174,001 | 2/1955 | Rosenberg | D26/10 |
| D184,698 | 3/1959 | White | D26/10 |

FOREIGN PATENTS OR APPLICATIONS

| | | | |
|---|---|---|---|
| 1,034,238 | 7/1958 | Germany | 174/158 R |
| 215,151 | 5/1924 | United Kingdom | 174/158 R |

OTHER PUBLICATIONS

"Thor Stand-off Insulators," Catalogue No. 151, published by Thor Ceramics, Inc., Bloomfield, New Jersey, 4 pp.

*Primary Examiner*—Laramie E. Askin
*Attorney, Agent, or Firm*—Steinberg & Blake

[57] ABSTRACT

A stand-off insulator for supporting conductors or the like so that they will be maintained in spaced relation to a supporting structure which carries the insulator. The insulator is in the form of a one-piece body of electrically non-conductive material having an elongated portion provided with a pair of opposed free end regions at one of which the elongated portion has a structure for fixing to this one free end region an article such as a clamp, bracket, or the like, while the elongated portion has at its other free end region a structure for mounting the body on a support.

10 Claims, 10 Drawing Figures

FIG. 1
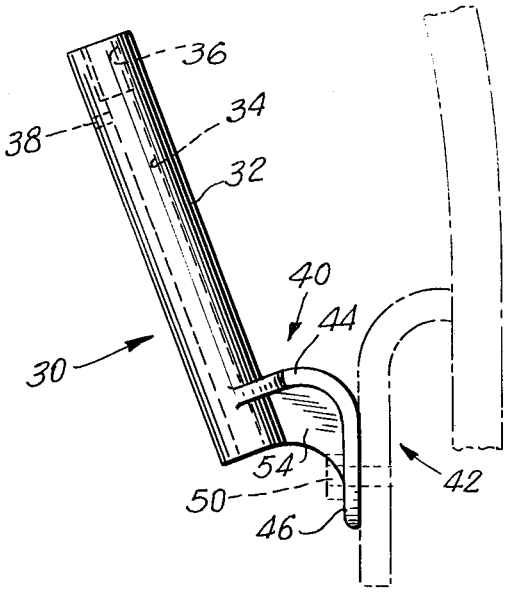
FIG. 2
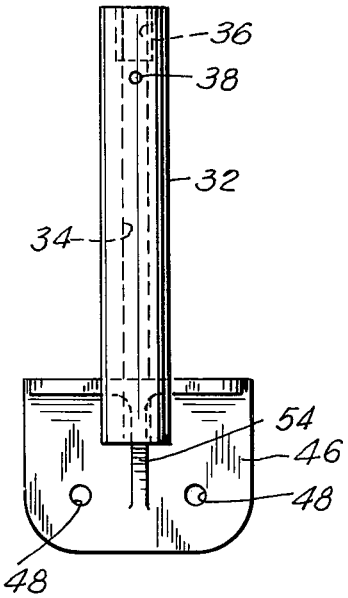
FIG. 3
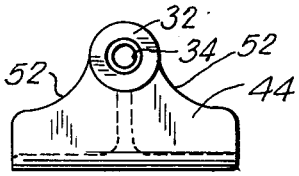
FIG. 4
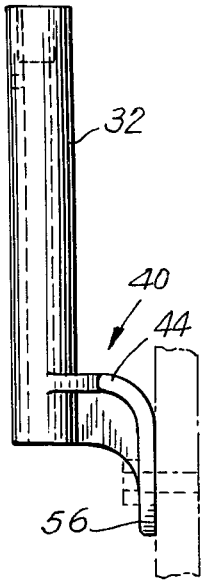
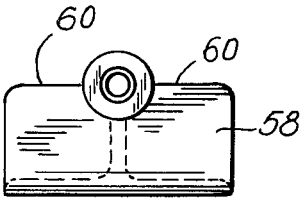
FIG. 5
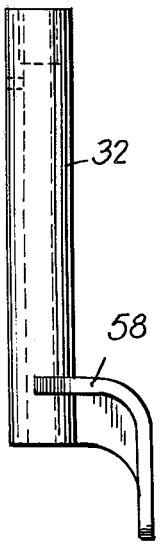
FIG. 6

FIG. 7
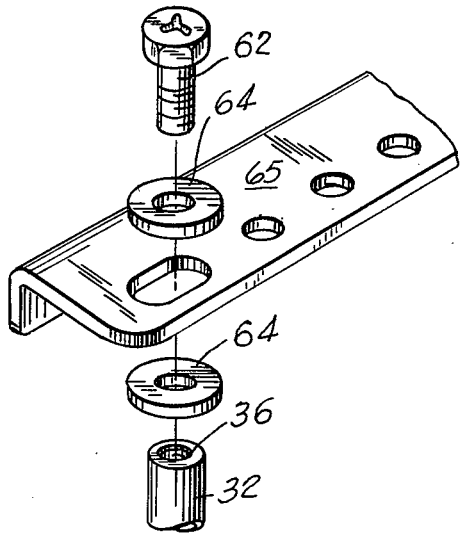
FIG. 8
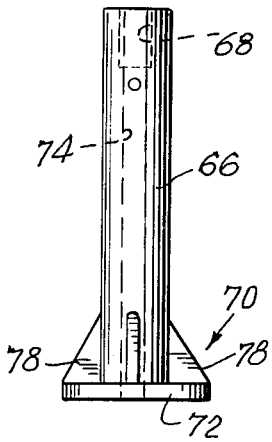
FIG. 9
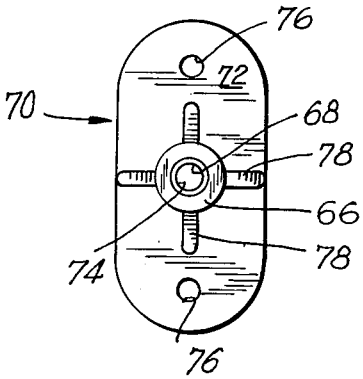
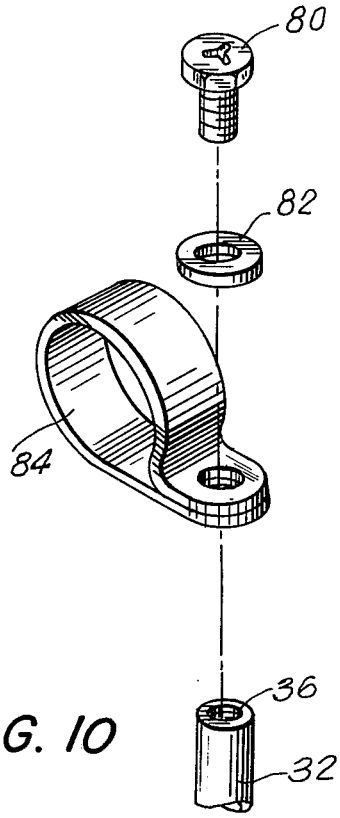
FIG. 10

STAND-OFF INSULATORS

BACKGROUND OF THE INVENTION

The present invention relates to insulators of the type used to support electrical conductors or the like in such a way that they will be incapable of contacting a supporting structure on which the insulator is mounted.

Insulators of this type have a wide variety of applications. For example, a modern aircraft requires extremely complex eletrical circuitry, and this circuitry in turn requires many conductors which must extend, for example, along the interior of the fuselage of the aircraft while being supported in such a way that these conductors will not contact or rub against the wall of the fuselage. Of course, such insulators are required in many different installations to carry conductors so that they will not rub against or otherwise contact supporting structures. Thus such insulators find a use in many different types of vehicles as well as in static structures.

At the present time insulators of this type, known as stand-off insulators, require a number of components which must be assembled together, so that the structure of such insulators is undesirably complex and expensive. In addition, the conventional insulators of this type do not reliably support conductors in such a way that they will be reliably maintained out of contact with a supporting structure. On the one hand if the conventional insulators are made sufficiently robust to withstand bending as a result of vibrations, inertia forces, and the like, they cannot maintain the conductors at the required distance from the supporting structure. On the other hand if such insulators are made of a length sufficient to locate the conductors at the required distance from the supporting structure, then they are easily bendable as a result of vibration or inertia forces or the like, and for this reason cannot reliably maintain the conductors out of contact with the supporting structure. In addition, the conventional insulators are undesirably heavy and large so that on the one hand they take up too much space and on the other hand add too much weight to a vehicle.

SUMMARY OF THE INVENTION

It is accordingly a primary object of the present invention to provide a structure which will avoid the above drawbacks.

Thus, it is an object of the present invention to provide a stand-off insulator which is far simpler than conventional insulators of this type, requiring no more than a single one-piece body.

Furthermore, it is an object of the present invention to provide an insulator of this type which while being capable of maintaining conductors reliably out of contact with a supporting structure at the same time are light and compact and nevertheless have the required rigidity to withstand vibrational and inertia forces or the like, while at the same time being relatively inexpensive.

According to the invention, the stand-off insulator consists in its entirety of a simple one-piece body of electrically non-conductive material having an elongated portion provided with a pair of opposed free end regions at one of which is a means for fixing to this one free end region an article such as a clamp, bracket, or the like, while the other free end region of the elongated portion carries a means for fixing the body to a suitable support.

BRIEF DESCRIPTION OF DRAWINGS

The invention is illustrated by way of example in the accompanying drawings which form part of this application and in which:

FIG. 1 is a side view of one embodiment of a stand-off insulator according to the invention, the insulator being shown in FIG. 1 fastened to a fragmentarily illustrated supporting structure;

FIG. 2 is a view of the structure of FIG. 1, as seen from the left of FIG. 1;

FIG. 3 is an end elevation of the structure of FIG. 1 as seen from the top of FIG. 1;

FIG. 4 is a side elevation, corresponding to FIG. 1, of another embodiment of a stand-off insulator according to the invention;

FIG. 5 is an end view, corresponding to FIG. 3, of a further variation of insulator according to the invention;

FIG. 6 is a side view of the insulator of FIG. 5;

FIG. 7 is a perspective illustration of one possible manner in which the insulators of FIGS. 1–6 may be used;

FIG. 8 is a side view of another embodiment of a stand-off insulator according to the invention;

FIG. 9 is an end view of the insulator of FIG. 8 as seen from the top of FIG. 8; and FIG. 10 is a perspective illustration of another manner in which any of the insulators of the invention may be used.

DESCRIPTION OF PREFERRED EMBODIMENTS

Referring first to FIGS. 1–3, the stand-off insulator 30 illustrated therein consists in its entirety of a single one-piece body made of an electrically non-conductive material. Preferably the insulator 30 is made of nylon which is filled with glass fibers. The insulator 30 has an elongated portion 32 which is straight and formed along its central axis with an elongated bore 34 which extends completely through the elongated portion 32. At its top end, as viewed in FIGS. 1 and 2, the elongated portion 32 has a means 36 for fixing to the top free end region of the portion 32 an article such as a bracket, clamp, or the like, as will be apparent from the description below. This fixing means 36 at the top free end region of the elongated portion 32 in the illustrated example takes the form of a part of the bore 34 which is internally threaded. As is apparent from FIG. 3, the elongated portion 32 is circular in cross section, and the same is true of the bore 34. Inwardly of the threaded portion 36 a transverse inspection hole 38 may be provided.

At its other free end region, namely the bottom free end region of portion 32, as viewed in FIGS. 1 and 2, this portion 32 has a means 40 for mounting the portion 32 on aa supporting structure 42. The fragmentarily illustrated supporting structure 42 may be considered as forming part of the interior of the fuselage of an aircraft, for example.

The mounting means 40 takes the form of a substantially L-shaped flange having one wall 44 which is fixed directly to the portion 32 and projects substantially perpendicularly therefrom, this one wall 44 being situated in a plane normal to the axis of the elongated portion 32. The wall 44 of the flange which forms the mounting means 40 is fixed to a second wall 46 which is flat and formed with a pair of bores 48 through which suitable fastening screws 50 or the like may extend for fastening the wall 46 of the mounting means 40 directly to the supporting structure 42. In the illustrated example the walls 44 and 46 include between themselves an angle on the order of 70° so that the part 32 makes an angle of 20° with respect to a vertical line extending parallel to the wall 46. The wall 44 has a pair of concavely curved edges 52 (FIG. 3) extending from opposed sides of the elongated portion 32 inwardly of the extremity of the bottom free end region thereof, as viewed in FIGS. 1 and 2. These curved edges 52 are symmetrical and are joined to the exterior surface of the elongated portion 32 at a plane which contains the central axis of the portion 32, as is apparent from FIG. 3.

In addition, this structure is provided with a strengthening fin 54 which is perpendicular to and extends from both of the walls 44 and 46, this fin 54 being situated in a plane which contains the axis of the elongated portion 32 and extending from the extremity of the bottom free end region thereof, as viewed in FIGS. 1 and 2, up to the wall 44. As was pointed out above, all of this structure of the insulator 30 is in the form of a single one-piece body of electrically non-conductive material.

The embodiment of the invention which is illustrated in FIG. 4 is identical with that of FIGS. 1–3 except that the mounting means 40 includes a fastening wall 56 which is perpendicular to the wall 44. Otherwise this embodiment is identical with that of FIGS. 1–3. Thus with the embodiment of FIG. 4 the axis of the elongated portion 32 is parallel to the wall 56 of the L-shaped flange of the mounting means 40.

The embodiment of FIGS. 5 and 6 is identical with that of FIG. 4 except that the wall 58, which corresponds to the wall 44, does not have the concave edges 52. Instead this wall 58 has edges 60 which extend in opposite directions from opposed side surfaces of the elongated portion 32, these edges 60 being located along a common straight line which extends perpendicularly across the axis of the elongated portion 32. Except for this difference the embodiment of FIGS. 5 and 6 is identical with that of FIG. 4.

FIG. 7 illustrates one possible manner in which the structure described above may be used. Thus the free end region of elongated portion 32 which has the fixing means 36 may receive a screw 62 which extends through washers 64 between which a bracket 65 is located. Any suitable conductors may be connected with this bracket, so that in this simple way the structure of the invention is capable of supporting conductors or the like at a suitable space from a supporting structure such as the structure 42.

A further embodiment of the invention is illustrated in FIGS. 8 and 9. Thus, the stand-off insulator of this embodiment includes an elongated portion 66 which is identical with the elongated portion 32 and has at its free end region, as viewed in FIG. 8, a fixing means 68 identical with the fixing means 36.

The bottom free end region of the elongated portion 66 also has a mounting means 70. However, in this case the mounting means 70 is in the form of a simple flange 72 which extends perpendicularly with respect to the axis of the bore 74 which extends completely through the elongated portion 66. This flange 70 has bores 76 through which fastening screws may extend. Also it has a number of strengthening fins 78 which are distributed circumferentially about the elongated portion 66 and which are of triangular configuration as illustrated.

Thus, with all of the embodiments described above it will be noted that although the elongated portion of the insulator has a considerable length and is relatively long and slender, nevertheless the entire structure is rendered quite rigid because of the mounting means and the strengthening fins, so that while the structure is of a light weight and small and compact, nevertheless it is capable of supporting conductors at a considerable distance from a support in such a way that the conductors will reliably be maintained out of contact with the supporting structure. The light weight of the structure is achieved in part as a result of the bore which passes completely through the elongated portion, this bore in addition facilitating the provision of the thread which forms the fixing means.

FIG. 10 illustrates a further example of a manner in which the structure of the invention may be used. Thus as may be seen from FIG. 10, the elongated portion 32 receives at its fixing means 36 a fastening screw 80 which extends through a washer 82 and bores at one end of a circular clamp or eye 84. Suitable conductors can pass through this clamp which thus can be fixed very readily to the fixing means at the one end region of the elongated portion of the insulator of the invention. Of course this structure which is shown in FIG. 10 can also be used with the embodiment of FIGS. 8 and 9.

Thus it is clear that with the present invention a one-piece body of insulating material provides a stand-off insulator which is inexpensive since it can readily be molded in one piece, while at the same time it is rugged and robust, capable of being readily mounted on a suitable support, for extending at the elongated portion at a desired angle with respect to the support. Thus in the case of FIGS. 8 and 9 the elongated portion will simply extend perpendicularly from the supporting structure, while in the case of FIGS. 4–6 the elongated portion of the insulator will extend parallel to while being maintained spaced from the supporting structure, and in the embodiment of FIGS. 1–3 the elongated portion is positioned at a predetermined angle with respect to the supporting structure. In all cases it is a simple matter to fasten to the outer free end region of the elongated portion of the insulator any suitable article such as the clamp of FIG. 10 or the bracket of FIG. 7, thus enabling conductors or other articles to be reliably supported in spaced relation with respect to a supporting structure.

What is claimed is:

1. A stand-off insulator, consisting of a one-piece body of electrically non-conductive material having an elongated portion provided with a pair of opposed free end regions at one of which said body has a means for releasably fixing to said one free end region an article such as a clamp, bracket, or the like, and at the other of which said body has a means for mounting said body on a support with said elongated portion extending in a given direction with respect to said support, said mounting means including a flange of substantially L-shaped configuration having one wall projecting from said elongated portion at said other free end region thereof inwardly of an extremity of said other free end region so that said elongated portion extends past and beyond said one wall of said flange up to said extremity of said other free end region of said elongated portion, said flange having a second wall extending angularly from said one wall thereof to be directly fastened to a support.

2. The combination of claim 1 and wherein said one free end region of said elongated portion is formed with an internally threaded bore which forms the means for fixing to said one free end region an article such as a clamp, bracket, or the like.

3. The combination of claim 1 and wherein said mounting means at said other free end region of said elongated portion includes at least one strengthening fin extending between said flange and an exterior surface of said elongated portion at said other free end region thereof.

4. The combination of claim 3 said elongated portion being straight and having a central axis, said one wall projecting in opposite directions from said elongated portion at one side thereof and being situated next to said elongated portion in a plane normal to said axis, and said strengthening fin being perpendicular to and extending from both of said walls while being situated in a plane which contains said axis and extending between said extremity of said other free end region of said elongated portion of said one wall of said flange.

5. The combination of claim 4 and wherein said second wall of said flange is perpendicular to said one wall thereof and situated in a plane which is parallel to said axis.

6. The combination of claim 4 and wherein said second wall is situated in a plane which forms an acute angle with a plane which contains said one wall.

7. The combination of claim 4 and wherein said one wall has a pair of symmetrical concave edges extending from opposed sides of said elongated portion at said free end region thereof.

8. The combination of claim 4 and wherein said one wall has a pair of symmetrical edges projecting from opposed sides of said elongated portion at said free end region thereof and situated along a common line which passes perpendicularly through the axis of said elongated portion.

9. The combination of claim 1 and wherein said body is made of nylon filled with glass fibers.

10. The combination of claim 1 and wherein said elongated portion is formed with a bore extending completely therethrough.

* * * * *